US006173798B1

(12) United States Patent
Bryant et al.

(10) Patent No.: US 6,173,798 B1
(45) Date of Patent: Jan. 16, 2001

(54) TUNGSTEN CARBIDE NICKEL- CHROMIUM ALLOY HARD MEMBER AND TOOLS USING THE SAME

(75) Inventors: William A. Bryant, McKeesport; Edward V. Conley, North Huntingdon; Ted R. Massa, Latrobe, all of PA (US)

(73) Assignee: Kennametal Inc., Latrobe, PA (US)

( * ) Notice: Under 35 U.S.C. 154(b), the term of this patent shall be extended for 0 days.

(21) Appl. No.: 09/256,807

(22) Filed: Feb. 23, 1999

(51) Int. Cl.[7] ..... E21B 10/46

(52) U.S. Cl. ..... 175/426; 75/240

(58) Field of Search ..... 175/425, 426, 175/427, 428; 75/240, 246

(56) References Cited

U.S. PATENT DOCUMENTS

| | | | | |
|---|---|---|---|---|
| 4,497,660 | * | 2/1985 | Lindholm | 75/240 |
| 4,682,987 | * | 7/1987 | Brady et al. | 51/293 |
| 4,684,405 | * | 8/1987 | Kolaska et al. | 75/240 |
| 4,963,183 | | 10/1990 | Hong | 75/241 |
| 5,023,145 | | 6/1991 | Lomax et al. | 428/614 |
| 5,305,840 | | 4/1994 | Liang et al. | 175/426 |
| 5,452,771 | * | 9/1995 | Blackman et al. | 175/353 |
| 5,856,626 | * | 1/1999 | Fischer et al. | 75/240 |

FOREIGN PATENT DOCUMENTS

| | | |
|---|---|---|
| 58-197203 | 11/1983 | (JP) . |
| 58-199804 | 11/1983 | (JP) . |
| 60-135502 | 7/1985 | (JP) . |
| 3-27621 | 4/1991 | (JP) . |
| 4-31012 | 5/1992 | (JP) . |
| 5-98369 | 4/1993 | (JP) . |
| 6-35638 | 5/1994 | (JP) . |
| 94-6289 | 7/1994 | (KR) . |

OTHER PUBLICATIONS

Brochure entitled Cast Versions of Alloy C (Alloy C 4c), date unknown.
Brochure entitled Alloy C–276 (UNS N10276) and Alloy C–4 (UNS N06455), date unknown.
Brochure entitled Ni–Cr–Mo Alloys, date unknown.
Brochure entitled Alloy C–22 (UNS N06022), date unknown.
Brochure entitled Alloy 625 (UNS N06625), date unknown.
Brochure entitled Sulfidation–Oxidation Behavior of a Ni–Co–Cr–Si Alloy in an SO2+O2 Atmosphere, date unknown.
Brochure entitled Adaptable Properties and Application Areas of Amorphous Metal Composite (AMC) Materials Having a Metallic Matrix and a Ceramic Hard Phase, date unknown.
Document entitled Chapter 25, Chemical Composition Requirements for Nickel and Nickel Al, date unknown.
Brochure entitled Development of a new Ni–Cr–W superalloy for application to high temperature structures, date unknown.

(List continued on next page.)

* cited by examiner

*Primary Examiner*—David Bagnell
*Assistant Examiner*—Jennifer R. Dougherty
(74) *Attorney, Agent, or Firm*—John J. Prizzi

(57) ABSTRACT

A hard member for use as a wear part or a hard insert for a point attack style of tool or a rotary style of tool. The hard member having a composition of between about 5 volume percent and about 40 volume percent binder alloy, and between about 60 volume percent and about 95 volume percent tungsten carbide. The tungsten carbide has an average grain size between about 1 micrometer and about 30 micrometers. The binder alloy comprises an alloy of nickel and chromium wherein the nickel ranges between about 70 weight percent and less than 93 weight percent and the chromium ranges between greater than 7 weight percent and about 30 weight percent.

17 Claims, 5 Drawing Sheets

OTHER PUBLICATIONS

Cobalt Facts Update, Sections 10 and 11, the Cobalt Development Institute, Aug., 1996.
Phase Diagrams of Binary Nickel Alloys, Nash, P. Editor, Monograph Series on Alloy Phase Diagrams, ASM International, 1989, pp. 75–84.
Brooke, K.J.A., World Directory of Hard Metals and Hard Materials, 6th Edition (1996), pp. D12, D13, D15, D73, D74, D78, D79, D80, D145, D147, D182, D183, D184, D196, D197, D222, D223, D226, and D227.
Nickel and Nickel Alloys, vol. 2, Metals Handbook, Tenth Edition (1990), pp. 428–445.
Fish et al. Abrasive Wear Effects in Rotary Rock Drilling, Reply to Paper in Transactions, vol. 68, 1958–59 at pp. 357–383, Tr. of Mining and Metallurgical Institute, pp. 194–198.
Doeg, Cemented Hard Metals–Their Basis with Particular Reference to the Tungsten–Carbide Cobalt System, J. South African Inst. of Mining and Metallurgy, Jul. 1960, pp. 663–687.
Latin, The Properties of of Tungsten Carbide–Cobalt Alloys used for Mineral Cutting Tools. Matallurgia, (Nov. 1961), pp. 211–216 & 267–273.
Roxborough, et al., The mechanical cutting characteristics of the Lower Chalk, Tunnels and Tunnelling (Jan. 1973), pp. 45–67.
Larsen–Basse, Wear of Hard–Metals in Rock Drilling: A Survey of the Literature, Powder Metallurgy, 1973, vol. 16, No. 31, pp. 1–32.
Bailey, et al., Wear Processes Exhibited by WC–Co Rotary Cutters in Mining, Wear, 29 (1974) pp. 117–128.
Perrott et al. Mechanisms of Wear of Tungsten Carbide–Cobalt Tools: I Rock–Drilling and Cutting Applications, J. of the Australian Institute of Metals, 19(4), 1974, pp. 229–240.
Blombery et al., Similarities on the mechanism of wear of tungsten carbide–cobalt tools in rock and metal cutting, Wear, 27(1974), pp. 383–390.
Kenny et al., Mechanism of wear ofcemented carbide tips on rock cutting tools, Wear, 30(1974), pp. 377–383.
Stjernberg et al., Wear Mechanisms due to Different Rock Drilling Conditions, Powder Metallurgy, 1975, vol. 18, No. 35, pp. 89–106.
Lardner, Cemented Carbides for Coal Mining, Colliery Guardian, Dec. 1977, pp. 919–923.
Hurt et al., Point Attack Tools: an Evaluation of Function and Use for Rock Cutting, The Mining Engineer, Mar., 1981, pp. 673–675.
Diamond Picks for shearers, International Mining, Jun. 1986, pp. 35–41.
Pastor, Present Status and Development of Tool Materials: Part 2 Drilling/Mining and Wear Parts, R&HM, Mar. 1988, pp. 21–28.
Warren et al., Laboratory Drilling Performance of PCD Bits, SPE Drilling Engineering, Jun. 1988, pp. 125–135.
Warren et al., Drag–bit Performance Modeling, SPE Drilling Engineering, Jun. 1989, pp. 119–127.
Sinor et al., Drag Bit Wear Model, SPE Drilling Engineering, Jun. 1989, pp. 128–136.
Santhanan et al., Cemented Carbides, ASM Handbook vol. 2 10th Edition, (1990) pp. 950–977.
Pollitt, et al. Lithological interpretation based on monitored drilling performance parameters, CIM Bulletin, Jul. 1991, pp. 25–29.
Clark, Rockbolt Drilling with PCD in Coal Mines, The South African Mechanical Engineer, vol. 41, Sep. 1991, pp. 335–341.
Rogers et al., Wear mechanism associated with rock excavation using attack picks, Mining Science and Technology, 12(1991), pp. 317–323.
von den Driesch et al., New Materials for Cutting Inserts in Picks for Boom Roadheaders, Gluckhauf–Forschungshefte 52 (1991) No. 31 [English translation].
Bureau of Mines, Technology News, "Breakthrough in Roof–Bolt Drilling Technology", Jul. 1992.
Walker et al., Wear and Performance of Single PCD Cutters under Simulated Downhole Conditions, PED vol. 40, ASME 1992.
Lin et al., Wear and failure mechanisms of Polycrystalline diamond compact bits, Wear 156 (1992) pp. 133–150.
Tian et al., The wear mechanisms of impregnated diamond bits, Wear 177 (1994) pp. 81–91.
Ogilvy et al., The Wear of Sintered Carbide Inserts on Raise Borer Cutters, pp. 211–225.
Yatskikh et al., Mining Machines and Systems, 4th Ed, Nedra Press, Moscow (1974), Basic Concepts of Coal Cutting, pp. 26–51.
Hanson et al., Effect of Symmetric Bit Wear and Attack Angle on Airborne Respirable Dust and Energy Consumption, Bureau of Mines Report No. 8395.
Speight et al., The influenec of operational parameters of roadheader productivity and efficiency with particular reference to cutting pick wear, Conference on Tribology in Mineral Extraction, Mechanical Engineering Publications, London (1984), C357/84.
Yardley et al., The Wear of Tools Used for Cutting Coal and Rock, Conference on Wear of Materials, San Francisco, California (1981) pp. 469–477.
Johnson et al., Compressive Strength is Not Enough, Chapter 119, Proceedings of the 27th Symposium on Rock Mechanics, Tuscaloosa, Alabama (1986), pp. 840–845.
Case History 416, Roof Bolt Drill Bits made with Stratapax Drill Blanks Reduce Cost of Producing Coal from Underground Mines, date unknown two pages.
Human et al., A Comparison Between Cemented Carbide Containing Cobalt–and Nickel–based Binders, Jour of Hard Materials, vol. 2, Nos.3–4 1991, pp. 245–256.
Aronsson et al., Trends in the Development of Tungsten Carbide Based Products Other Than Metal Cutting and Rock Drilling, pp. 74–88.
Schmid, New Hardmetal Alloys with Improved Erosion and Corrosion Resistance, R&HM, Sep. 1987, pp. 145–148.
Wentzel et al. Erosion–corrosion resistance of tungsten carbide hardmetals with different binder compositions, Wear 181–183 (1995), pp. 63–69.

TUNGSTEN CARBIDE NICKEL-CHROMIUM ALLOY HARD MEMBER AND TOOLS USING THE SAME

BACKGROUND

The present invention pertains to a tungsten carbide nickel-chromium alloy hard member for use as a wear member, as well for use as a hard insert in a tool. Exemplary wear members include dies, plungers and nozzles. Exemplary tools include point attack style tools (e.g., a road planing tool or a point attack mine tool or an open-face longwall tool) and rotary style tools (e.g., a roof drill bit or a tri-cone bit).

Referring to the hard insert for a point attack style of tool, such point attack style tools have been typically used to penetrate the earth strata or other substrates (e.g., asphalt roadway surfaces) wherein the point attack style tool is carried, either in a rotatable or a non-rotatable fashion, by a driven member (e.g., drum or chain). The typical point attack style tool has had a hard insert affixed at the axially forward end thereof wherein the hard insert has been the part of the point attack style tool which first impinged upon the earth strata or other substrate.

Referring to the hard insert for the rotary style tool for penetrating the earth strata, there are one or more hard inserts at the axially forward end thereof. In the case of a typical roof drill bit, such a rotary tool has been typically used to drill holes in a mine roof. In the case of a tri-cone drill bit, such a rotary tool has been used to drill holes for oil wells and the like. The typical rotary tool has had a hard insert affixed at the axially forward end thereof wherein the hard insert has been the part of the rotary tool which first impinged upon the earth strata or other substrate.

Heretofore, for both the point attack style tool and the rotary style tool the hard insert has comprised a tungsten carbide-based alloy wherein the binder has been cobalt or a cobalt-based alloy. While the tungsten carbide-cobalt hard insert has achieved successful results, there have been some drawbacks to the use of a hard insert made from tungsten carbide and cobalt.

One drawback has been the fact that up to approximately forty-five percent of the world's primary cobalt production has been from politically unstable regions, i.e., political regions which have in the past decade experienced armed or peaceful revolutions wherein the ruling government has changed very quickly. Thus, there has always remained the potential that the supply of cobalt could be interrupted due to any one of a number of causes. The unavailability of cobalt would, of course, be an undesirable occurrence. Because of the fact that about twenty-six percent of the world's annual primary cobalt production has been used for the manufacture of superalloys for advanced aircraft turbine engines, cobalt has been designated as a strategic material. These two factors have resulted in cobalt having been relatively expensive, which, in turn, has raised the cost of the hard insert, as well as the cost of the overall point attack style tool. Such an increase in the cost of the point attack style tool has been an undesirable consequence of the use of cobalt in the hard insert.

Wear members (e.g., plungers), point attack style tools, and rotary tools may very well operate in environments which are corrosive. While the tungsten carbide-cobalt materials for use as a wear member or a hard insert have been adequate in such environments, there remains the objective to develop a wear member, as well as a hard insert, which has improved corrosion resistance while maintaining adequate wear characteristics.

It can thus be seen that while the use of tungsten carbide-cobalt wear members and hard inserts have been successful, there remains a need to provide a wear member, as well as a hard insert, which does not have the drawbacks, i.e., cost and the potential for unavailability, inherent with the use of cobalt set forth above. There also remains a need to develop a wear member, as well as a hard insert, for use in corrosive environments which possesses improved corrosion resistance while maintaining adequate wear characteristics.

SUMMARY

In one form thereof, the invention is a tool which includes a tool body, and a hard insert affixed to the tool body. The composition of the hard insert comprises from about 5 volume percent to about 40 volume percent binder alloy and between about 60 volume percent and about 95 volume percent tungsten carbide. The tungsten carbide has an average grain size between about 1 micrometer and about 30 micrometers. The binder alloy comprises an alloy of nickel and chromium wherein the nickel ranging between about 70 weight percent and less than 93 weight percent and the chromium ranging between greater than 7 weight percent and about 30 weight percent.

In another form thereof, the invention is a hard insert for use in a rotary tool having a tool body wherein the hard insert is affixed to the tool body. The composition of the hard insert comprises between about 5 volume percent and about 40 volume percent binder alloy, and between about 60 volume percent and about 95 volume percent tungsten carbide. The tungsten carbide has an average grain size between about 1 micrometer and about 30 micrometers. The binder alloy comprises an alloy of nickel and chromium wherein the nickel ranges between about 70 weight percent and less than 93 weight percent and the chromium ranges between greater than 7 weight percent and about 30 weight percent.

In yet another form thereof, the invention is a wear part which comprises between about 5 volume percent and about 40 volume percent binder alloy, and between about 60 volume percent and about 95 volume percent tungsten carbide. The tungsten carbide has an average grain size between about 1 micrometer and about 30 micrometers. The binder alloy comprises an alloy of nickel and chromium wherein the nickel ranges between about 70 weight percent and less than 93 weight percent and the chromium ranges between greater than 7 weight percent and about 30 weight percent.

BRIEF DESCRIPTION OF THE DRAWINGS

The following is a brief description of the drawings that form a part of this patent application.

DETAILED DESCRIPTION

Figure 1:
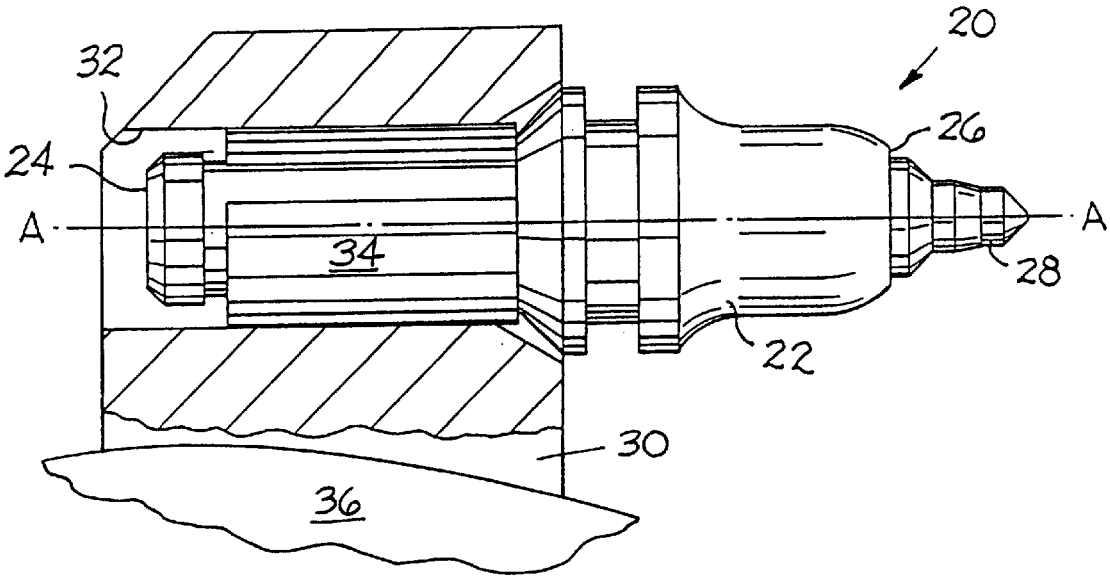
FIG. 1 is a side view of a road planing tool rotatably held in a block, i.e., a rotatable point attack style tool, mounted to a road planing drum wherein a portion of the block has been removed to show the road planing tool.

Referring to FIG. 1, there is illustrated a road planing tool generally designated as 20. Road planing tool 20 is considered to be a rotatable point attack style tool. Road planing tool 20 has an elongate steel body 22 which has an axially rearward end 24 and an opposite axially forward end 26. A hard insert (or tip) 28 is affixed in a socket in the axially forward end 26 of the tool body 22. The composition of the material from which the hard insert 28 is made will be discussed in detail hereinafter.

The road planing tool 20 is rotatably carried by a block 30. Block 30 contains a bore 32 in which the rearward portion (or shank) of the tool 20 is retained by the action of a resilient retainer sleeve 34 such as that described in U.S. Pat. No. 4,201,421 to DenBesten et al., which is incorporated by reference herein. The block 30 is mounted to a road planing drum 36. During operation, the road planing tool 20 rotates about its central longitudinal axis A—A. Further description of the road planing tool 20, and especially the geometry of the hard insert 28, is found in U.S. Pat. No. 5,219,209 to Prizzi et al. entitled ROTATABLE CUTTING BIT INSERT assigned to Kennametal Inc. of Latrobe, Pa., the assignee of the present invention. U.S. Pat. No. 5,219,209 is hereby incorporated by reference herein.

Figure 2:
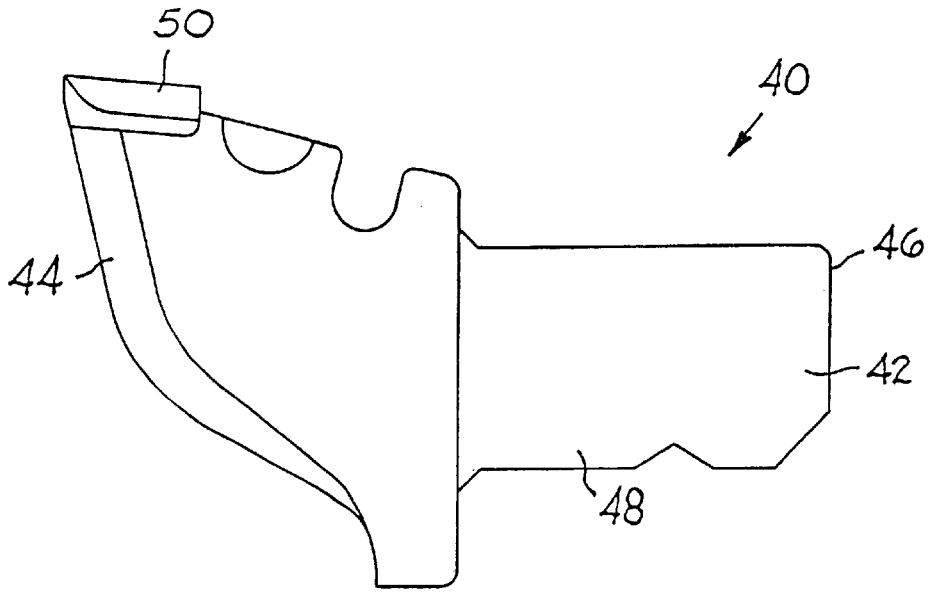
FIG. 2 is a side view of a longwall style mine tool which is held a non-rotatable fashion, i.e., a non-rotatable point attack style tool, by a holder mounted to a driven chain or other driven member.

Referring to FIG. 2, there is illustrated a non-rotatable longwall style of mine tool generally designated as 40. The longwall mine tool 40 is considered to be a point attack style tool. Longwall tool 40 has an elongate steel body 42 with a forward end 44 and a rearward end 46. The body 42 presents a rearward shank 48 adjacent to the rearward end 46 thereof. The rearward shank 48 is of a generally rectangular cross-section. A hard insert 50 is affixed in a socket at the forward end 44 of the tool body 42. The composition of the material from which the hard insert 50 is made will be discussed in detail hereinafter. During operation, the longwall tool 40 does not rotate about its central longitudinal axis.

The composition of material from which the hard insert 28 for the road planing tool 20 or the hard insert 50 for the longwall style mine tool 40 comprises a cemented tungsten carbide comprising a nickel-chromium binder alloy and tungsten carbide. In an embodiment, the binder alloy has a composition comprising between about 70 weight percent and about 90 weight percent nickel and between about 10 weight percent and about 30 weight percent chromium. In a preferred embodiment, the binder alloy has a composition comprising about 77.7 weight percent nickel and about 22.3 weight percent chromium.

The preferred broadest range of the binder alloy in the cemented tungsten carbide is from about 5 volume percent to about 40 volume percent. Another preferred range of the binder alloy is between about 16 volume percent and about 40 volume percent. Still another preferred (and narrower) range of the binder alloy in the cemented tungsten carbide is from about 19 volume percent to about 36 volume percent. Still another preferred range (and even narrower) of the binder alloy in the cemented tungsten carbide is from about 24 volume percent to about 28 volume percent.

The grain size of the tungsten carbide comprises a broadest range of about 1 micrometer ($\mu$m) to about 30 $\mu$m. A mediate range for the grain size of the tungsten carbide is from about 1 $\mu$m to about 25 $\mu$m. Another mediate range for the grain size of the tungsten carbide is from about 1 $\mu$m to about 13 $\mu$m. The narrower range for the grain size of the tungsten carbide is from about 1 $\mu$m to about 6 $\mu$m. The average grain size ranges from about 3 $\mu$m to about 9 $\mu$m. For road planing applications, the preferred average grain size of the tungsten carbide is about 8.3 $\mu$m. For mining (e.g., coal mining) point attack applications, the preferred average grain size of the tungsten carbide is about 6.9 $\mu$m.

The typical process for making the hard insert is a conventional powder metallurgical technique. See, e.g., P. Schwarzkopf, et al., *Cemented Carbides,* The MacMillian Company, New York (1960) and I. A. Brookes, *World Directory and Handbook of Hard Metals and Hard Materials,* International Carbide Data, Hertforshire, United Kingdom, the subject matter of both is incorporated herein by reference. Generally speaking, the powder components of the hard insert are first blended such as, for example, by ball milling, into a powder mixture. The powder mixture is then consolidated by pressure such as, for example, by pressing, into a green compact. The green compact is then further densified under heat or heat and pressure to form the sintered hard insert. Exemplary sintering parameters comprise a sintering temperature of 2700° F. (1482° C.) for a duration of 45 minutes under a pressure of 800 pounds per square inch (psi) [1920 kilograms per square centimeter] in an argon atmosphere. It should be appreciated that other sintering parameters and cycles may be suitable to make the hard insert of the present invention.

Tests were conducted to determine the wear of a standard Kennametal UC765KSAL style of point attack conical bit using a hard insert comprising a standard tungsten carbide-cobalt composition (i.e., Kennametal Grade 3560) as compared to the same style of point attack conical bit using a hard insert made of tungsten carbide and a specific embodiment of the nickel-chromium binder alloy of the invention (i.e., Experimental Grades TC688 and TC714). The compositions and selected properties of the hard inserts of the point attack conical bits are set forth in Table I below. It should be appreciated that the composition in volume percent of Experimental Grades TC688 and TC714 was 26 volume percent nickel-chromium binder alloy and 74 volume percent tungsten carbide. The binder alloy comprised about 20 weight percent chromium and about 80 weight percent nickel.

TABLE I

Compositions and Selected Properties of Point Attack Conical Bits

| Composition | K3560 | TC688 | TC714 |
|---|---|---|---|
| WC (weight percent) | 90.5 | 84.24 | 84.05 |
| Co (weight percent) | 9.5 | — | — |
| Ni (weight percent) | — | 12.61 | 12.68 |
| Cr (weight percent) | — | 3.15 | 3.17 |
| Properties | | | |
| Hardness ($R_A$) | 86.1 | 85.3 | 87.0 |
| Coercive Force ($H_C$) | 55 | 6 | 6 |
| Magnetic Saturation (%) | 96.5 | — | — |
| Grain Size ($\mu$m) | 1–25 | 1–8 | 1–6 |
| Porosity (ASTM) | — | A00–B00–C00 | A00–B00–C00 |
| Density(g/cc) | 14.40 | 13.60 | 13.51 |

In regard to the physical properties, the Table I sets forth the hardness in Rockwell A. The coercive force is set forth in oersteds. The magnetic saturation is set forth in percent wherein 100 percent is equal to about 202 microtesla cubic meter per kilogram-cobalt ($\mu Tm^3/kg$) (about 160 gauss cubic centimeter per gram-cobalt (gauss-$cm^3$/gm)). The grain size is set forth in micrometers ($\mu$m). The Table I sets forth the porosity according to the ASTM Designation B 276–86 entitled "Standard Test Method for Apparent Porosity in Cemented Carbides"). The density is set forth in grams per cubic centimeter (g/cc). The hard inserts for all of the point attack conical bits (standard and those of the invention) were brazed to the steel bit bodies using Handy & Harman 548 braze alloy. The HANDY HI-TEMP 548 braze alloy from Handy & Harman, Inc., New York, N.Y. The HANDY HI-TEMP 548 braze alloy has the following composition: 55±1.0 weight percent copper, 6±0.5 weight percent nickel, 4±0.5 manganese, 0.15±0.05 weight percent silicon with the balance zinc and 0.50 weight percent total impurities. Additional information about HANDY HI-TEMP 548 can be found in Handy & Harman Technical Data Sheet No. D-74.

In regard to the production of the powder mixture for the Experimental Grade TC688 alloy, a starting mixture (including a suitable amount of paraffin lubricant) of 4143.5 grams of tungsten carbide (with an average grain size of 25 $\mu$m), 320 grams of nickel, 186 grams of chromium carbide [which contains 160.2 grams of chromium], and 30.5 grams of tungsten metal were ball milled for ten hours. Another 320 grams of nickel were added to the ball milled mixture and this mixture was ball milled for six hours. Another 30.4 grams of tungsten metal were then added to this ball milled mixture, and this mixture was then ball milled for another four hours. Finally, another 45.1 grams of tungsten metal were added to the ball milled mixture, and the mixture was then ball milled for another four hours. This powder mixture, with the lubricant removed therefrom, was used to form the hard inserts per the processing procedure set forth below.

For Experimental Grade TC688, the following procedure was used to produce the hard inserts from these respective powder mixtures: (1) the powder mixture was pressed into a green compact; (2) the green compact was sintered at 2700° F. (1482° C.) for 45 minutes under a pressure of 800 psi (1920 kilograms per square centimeter) in an argon atmosphere.

In regard to the production of the powder mixture for the Experimental Grade TC714 alloy, a starting mixture (including a suitable amount of paraffin lubricant)of 4143.5 grams of tungsten carbide (with an average grain size of 3.5 $\mu$m), 320 grams of nickel, 186 grams of chromium carbide [which contains 160.2 grams of chromium], and 30.5 grams of tungsten metal were ball milled for ten hours. Another 320 grams of nickel were then added to the ball milled mixture and this mixture was ball milled for two hours. Then 45.4 grams of tungsten metal were added to the ball milled mixture, and this mixture was then ball milled for another four hours. This resultant powder mixture, with any lubricant removed therefrom, was used to form the hard inserts per the processing procedure set forth below.

For Experimental Grade TC714, the following procedure was used to produce the hard inserts from these respective powder mixtures: (1) the powder mixture was pressed into a green compact; (2) the green compact was sintered at 2825° F. (1552° C.) for 45 minutes under a pressure of 800 psi (1920 kilograms per square centimeter) in an argon atmosphere.

The tests were conducted using a conical bit tester comprising an elongate mining drum. The mining drum was rotatable about its central longitudinal axis. A number of support blocks were attached to the drum. Each support block had a bore therein wherein each conical bit was rotatable retained within the bore of its respective block. Each conical bit was rotatable about its central longitudinal axis. Each conical bit was positioned as a zero degree skew angle and a 45 degree attack angle. The pick lines were spaced at two inch (5.08 centimeter) intervals. The drum operated at a rotational speed of 60 revolutions per minute and a feed rate of four feet (1.22 meters) per minute. The cut depths were one-half inch (1.27 centimeters). Thirty-two passes were made over a four foot cutting length generating 128 linear feet (39.0 meters) cut per bit. The substrate was sandstone with an approximate compressive strength of 8000 pounds per square inch (19,200 kilograms per square centimeter).

After completion of the testing, the bits were removed and examined for wear. The hard inserts were de-brazed and sand blasted to remove any remaining residual braze material. Each hard insert was weighed and compared to the original weight. The results are set forth in Table II below.

TABLE II

Original and Post-Test Weights (grams) of the Hard Inserts

| Grade/ Weight | K3560 | TC688 | TC714 |
|---|---|---|---|
| Original Weight (Grams) | 25.9177 | 24.1471 | 24.3266 |
| Post-Test Weight (grams) | 25.6958 | 21.3227 | 21.4307 |
| Weight Loss (grams) | −0.9914 | −2.8244 | −2.8959 |
| Weight Loss (%) | −0.8562 | −11.6743 | −11.9043 |

Although the point attack bits of the invention did not exhibit as good as wear as the standard point attack bit, the wear was sufficiently good so as to demonstrate the merits of the instant invention. The applicants believe that with a reduction in the binder alloy content and a coarsening of the grain size of the tungsten carbide, the wear properties of the WC—Ni—Cr hard insert will improve so as to be comparable with those of the standard WC—Co hard insert. Thus, these tests show that the instant invention provides a point attack bit using a hard insert with a binder alloy which has cost advantages over the cobalt binder of standard bits.

Referring to the corrosion resistance, although tests were not performed under corrosive conditions, i.e., wet, applicants believe that under corrosive conditions the performance of the point attack style tool of the invention would be better than, or at least comparable to, that of the conventional point attack style tool. For example, the corrosion resistance of the WC—Ni—Cr hard inserts would be desirable in certain applications, such as, for example, like potash mining and roto-percussive drilling in gold mining where the presence of numerous sulfite stringers and low pH water make corrosion resistance by the hard insert of special benefit.

It can thus be seen that applicants' invention provides for a point attack style tool, as well as the hard insert for the point attack style tool, which overcomes certain drawbacks inherent in the use of cobalt as a binder in the hard insert. More specifically, the use of a nickel-chromium binder alloy instead of a cobalt binder alloy in the hard insert reduces the cost of the hard insert, and hence, the cost of the overall point attack style tool. The use of a nickel-chromium binder alloy instead of a cobalt binder alloy in the hard insert eliminates the potential that the principal component, i.e., cobalt, of the binder alloy will be unavailable due to political instability (or other reasons) in those countries which possess significant cobalt reserves. It also becomes apparent that applicants' invention provides a point attack style tool, and a hard insert therefor, which possess improved corrosion resistance while still providing adequate wear properties.

Figure 3:
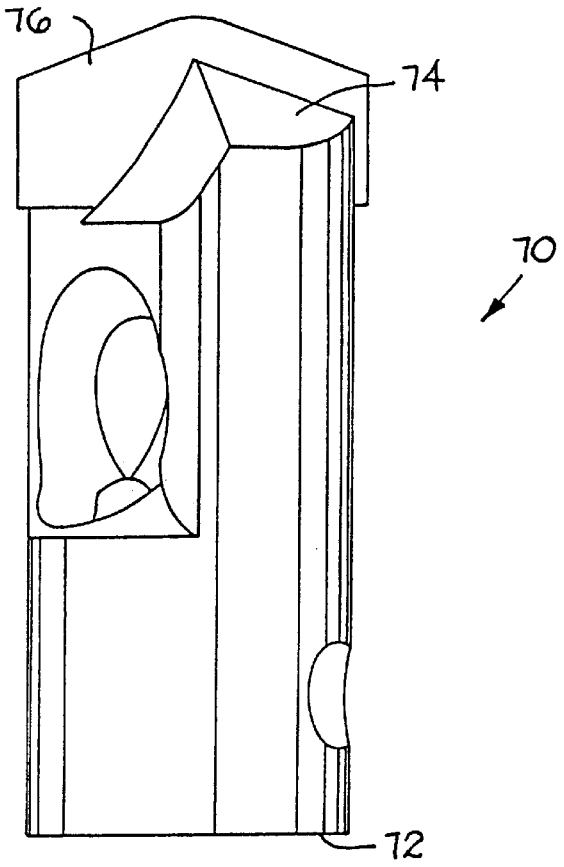
FIG. 3 is a side view of a roof drill bit of the style KCV4-1RR (Roof Rocket) made by Kennametal Inc. of Latrobe, Pa.

Referring to FIG. 3, there is illustrated a roof drill bit, generally designated as 70, of the style KCV4-1RR (Roof Rocket) made and sold by Kennametal Inc. of Latrobe, Pa. 15650 (the assignee of the present patent application). Roof drill bit 70 has an elongate body with an axially rearward end 72 and an axially forward end 74. A hard insert 76 is affixed to the elongate body at the axially forward end 74 thereof. In addition to the style illustrated in FIG. 3, applicants contemplate that the roof drill bits which may use cutting inserts of the compositions set forth herein include the roof drill bit shown and described in pending U.S. patent application Ser. No. 08/893,031 filed on Jul. 15, 1997 for a ROTATABLE CUTTING BIT ASSEMBLY WITH WEDGE-LOCK RETENTION ASSEMBLY by Ted R. Massa, Robert H. Montgomery, William P. Losch, and David R. Siddle, and assigned to Kennametal Inc. of Latrobe, Pa., and the roof drill bit shown and described in pending U.S. patent application Ser. No. 08/893,059 filed on Jul. 15, 1997 for a ROTATABLE CUTTING BIT ASSEMBLY WITH CUTTING INSERTS by Ted R. Massa and David R. Siddle, and assigned to Kennametal Inc. of Latrobe, Pa., and the roof drill bit shown and described in pending U.S. patent application Ser. No. 09/108,181 filed on Jul. 1, 1998 for a ROTATABLE CUTTING BIT ASSEMBLY WITH CUTTING INSERTS by Ted R. Massa and David R. Siddle, and assigned to Kennametal Inc. of Latrobe, Pa. Each of the three above-mentioned pending patent applications (Ser. Nos. 08/893,031 and 08/893,059 and 09/108,181) to Massa and Siddle are hereby incorporated by reference herein.

Referring to the hard insert 76 of the roof drill bit 70, the composition of the hard insert 76 comprises a nickel-chromium binder alloy and tungsten carbide. The broadest preferred range for the binder alloy in the hard insert 76 is between about 5 volume percent and about 40 volume percent. A mediate preferred range for the binder alloy in the hard insert 76 of the roof drill bit 70 is from between about 8 volume percent and about 18 volume percent. The binder alloy composition ranges between a broadest preferred range of about 70 weight percent and about 97 weight percent nickel and between about 3 weight percent and about 30 weight percent chromium. A mediate preferred rage for the binder alloy composition is between about 90 weight percent and about 97 weight percent nickel and between about 3 weight percent and about 10 weight percent chromium. The broader range for the average grain size of the tungsten carbide in the hard insert 76 of the roof drill bit 70 is from about 1 micrometer ($\mu$m) to about 30 $\mu$m. A mediate preferred range for the average grain size of the tungsten carbide is between about 1 $\mu$m and about 9 $\mu$m. A narrower, more preferred, range for the grain size of the tungsten carbide is from about 3 $\mu$m to about 9 $\mu$m. For a roof drill bit application, the preferred average grain size of the tungsten carbide is about 4.1 $\mu$m.

Figure 4:
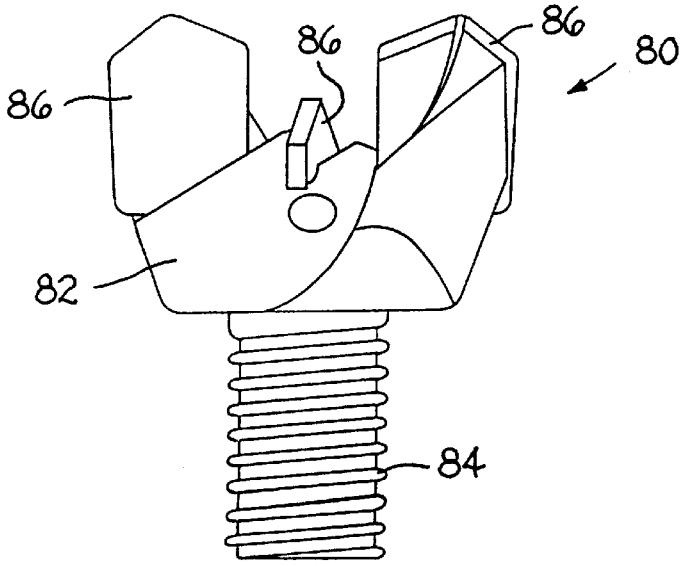
FIG. 4 is a side view of a two prong rotary bit of the style RDTC made by Kennametal Inc. of Latrobe, Pa.

Referring to FIG. 4, there is illustrated a two-prong rotary bit, generally designated as 80, of the style RDTC made and sold by Kennametal Inc. of Latrobe, Pa. 15650 (the assignee of the present patent application). Two-prong rotary bit 80 has a head 82, which is at the axially forward portion of the two-prong rotary bit 80. The two-prong rotary bit 80 also has a shank 84 at the axially rearward portion of the two-prong rotary bit 80. The shank 84 is integral with the head 82. The head 82 carries three hard inserts 86 in the fashion shown in FIG. 4.

Referring to the hard insert 86 of the two-prong rotary bit 80, the preferred composition of the hard insert 86 comprises 13 volume percent of a nickel-chromium binder alloy and the balance (i.e., 87 volume percent) tungsten carbide. The binder alloy composition ranges between about 70 weight percent and about 97 weight percent nickel and between about 3 weight percent and about 30 weight percent chromium. A mediate range for the binder alloy composition ranges between about 90 weight percent and about 97 weight percent nickel and between about 3 weight percent and about 10 weight percent chromium.

The broader range for the average grain size of the tungsten carbide is from about 1 micrometer ($\mu$m) to about 30 $\mu$m. A mediate range for the average grain size of the tungsten carbide is between about 1 $\mu$m and about 9 $\mu$m. A narrower, more preferred range for the grain size of the tungsten carbide is from about 3 $\mu$m to about 9 $\mu$m.

Figure 5:
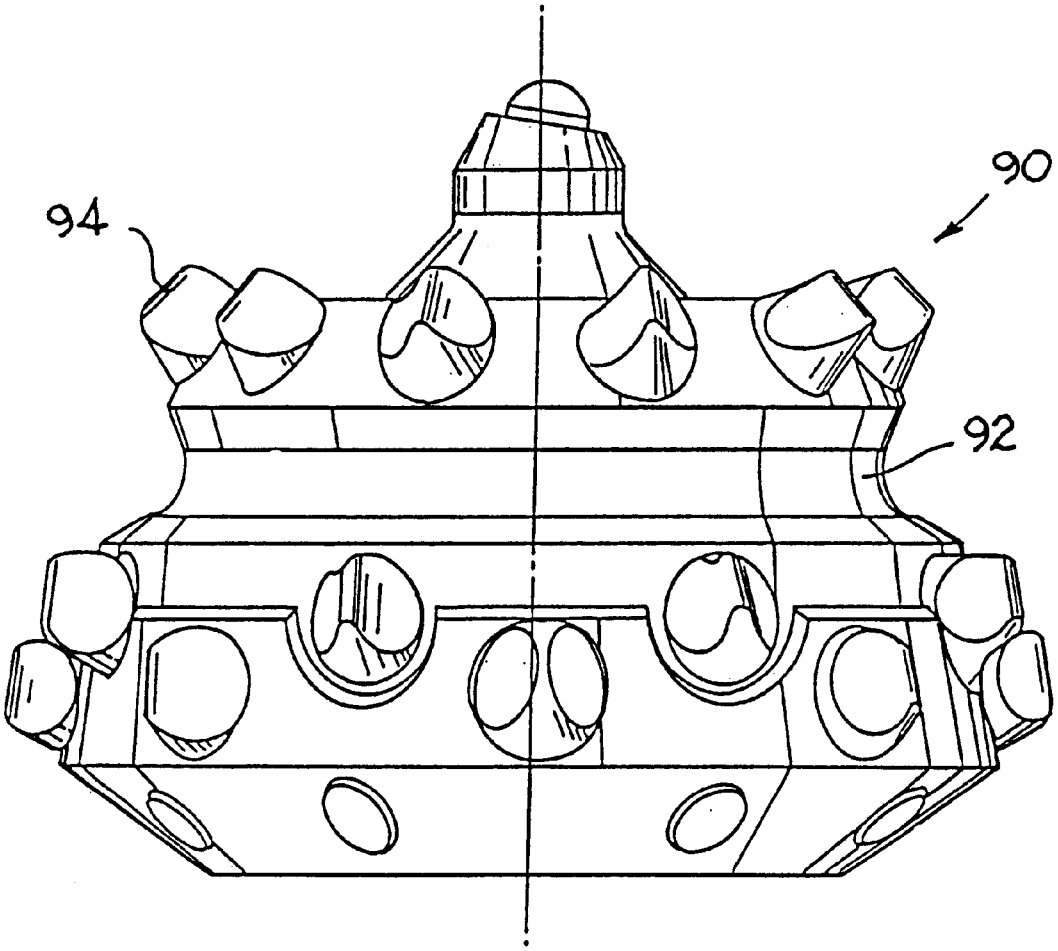
FIG. 5 is a side view of a drill bit used for downhole drilling.

Referring to FIG. 5, there is illustrated a drill bit, generally designated as 90, for downhole drilling such as is shown in U.S. Pat. No. 4,108,260 for a ROCK BIT WITH SPECIALLY SHAPED INSERTS to Bozarth. Drill bit 90 has a drill bit body 92 which receives a plurality of hard inserts 94.

The hard inserts 94 of the drill bit 90 comprise a nickel-chromium binder alloy and tungsten carbide. The broader range for the binder alloy in the hard insert 94 is from about 5 volume percent to about 40 volume percent. A narrower range for the binder alloy in the hard insert 94 is from about 5 volume percent to about 20 volume percent. The broadest range for the binder composition comprises from about 70 weight percent to about 97 weight percent nickel and from about 3 weight percent to about 30 weight percent chromium wherein a more mediate range the binder composition comprises from about 90 weight percent to about 97 weight percent nickel and from about 3 weight percent to about 10 weight percent chromium.

For hard inserts 94, a broader range for the average grain size of the tungsten carbide is from about 1 $\mu$m to about 30 $\mu$m. A mediate range for the average grain size of the tungsten carbide is from about 1 $\mu$m to about 9 $\mu$m. A narrower, and more preferred, range for the average grain size of the tungsten carbide is from about 3 $\mu$m to about 5 $\mu$m.

The typical process for making the hard insert is a conventional powder metallurgical technique such as that described above in this patent application (See e.g., P. Schwartzkopf, et al., *Cemented Carbides,* The MacMillian Company, New York, and J. A. Brookes, *World Directory and Handbook of Hard Metals,* International Carbide Data, Hartforshire, United Kingdom).

Applicants tested a roof drill bit using a hard insert made of a specific composition within the scope of the invention against a commercial roof drill bit using a hard insert made from Kennametal Grade K3012. The tests were performed in granite.

In regard to the production of the powder mixture [Experimental Grade TC609] for the hard insert according to the invention, a starting mixture (including a sufficient amount of paraffin lubricant) of 4479.7 grams of tungsten carbide (an average grain size of 35 $\mu$m), 234.5 grams of nickel, 36.0 grams of chromium carbide (contains 31.0 grams of chromium), and 15.3 grams of tungsten metal were ball milled for ten hours. Then another 234.5 grams of nickel were added to the ball milled mixture, and then ball milled for another six hours. The powder mixture, not including any lubricant, was then formed into the hard insert.

For Experimental Grade TC609, the following procedure was used to produce the hard inserts from these respective powder mixtures: (1) the powder mixture was pressed into a green compact; (2) the green compact was sintered at 2700° F. (1482° C.) for 45 minutes under a pressure of 800 psi (1920 kilograms per square centimeter) in an argon atmosphere.

The composition and physical properties of the Experimental Grade TC609 and the Kennametal Grade K3012 are set forth below in Table III. Experimental Grade TC609 comprised 17 volume percent binder (Ni—Cr) alloy and 83 volume percent tungsten carbide. The nickel-chromium binder alloy comprised about 92.9 weight percent nickel and about 7.1 weight percent chromium.

TABLE III

Composition and Physical Properties for Experimental Grade TC609 and Kennametal Grade K3012

| Grade/ Composition or Property | K3012 | TC609 |
|---|---|---|
| WC (weight percent) | 93.8 | 89.90 |
| Co (weight percent) | 6.2 | — |
| Ni (weight percent) | — | 9.38 |
| Cr (weight percent) | — | 0.72 |
| Hardness ($R_a$) | 89.7 | 89.2 |
| Coercive Force ($H_C$) | 115 | — |
| Magnetic Saturation | 95 | 0.4 |
| Grain Size (Range) ($\mu$m) | 1–12 | 1–5 |
| Porosity | | A02–B00–C00 |
| Density (g/cc) | 14.85 | 14.51 |

In regard to the physical properties, the Table III sets forth the hardness in Rockwell A. The coercive force is set forth in oersteds. The magnetic saturation is set forth in percent wherein 100 percent is equal to about 202 microtesla cubic meter per kilogram-cobalt ($\mu Tm^3/kg$) (about 160 gauss cubic centimeter per gram-cobalt (gauss-$cm^3$/gm)). The grain size is set forth in micrometers ($\mu$m). The Table III sets forth the porosity according to the ASTM Designation B 276-86 entitled "Standard Test Method for Apparent Porosity in Cemented Carbides"). The density is set forth in grams per cubic centimeter (g/cc).

The hard inserts for all of the roof drill bits (standard and those of the invention) were brazed to the steel bit bodies using Handy & Harman 548 braze alloy. The HANDY HI-TEMP 548 braze alloy from Handy & Harman, Inc., New York, N.Y. The HANDY HI-TEMP 548 braze alloy has the following composition: 55±1.0 weight percent copper, 6±0.5 weight percent nickel, 4±0.5 manganese, 0.15±0.05 weight percent silicon with the balance zinc and 0.50 weight percent total impurities. Additional information about HANDY HI-TEMP 548 can be found in Handy & Harman Technical Data Sheet No. D-74.

The results of the testing are set forth in Table IV below. The test assembly arranges the bit so that it is continuous contact with the substrate (e.g., granite) during the entire drilling operation.

TABLE IV

Test Results from Drillimg in Granite

| Sample | Rotational Speed RPM (avg.) | Hole Depth (inches) | Feed Rate (start/ end/avg.) | Thrust (lbs) (Avg.) | Torque (in-lbs) (Avg.) | Comments |
|---|---|---|---|---|---|---|
| Conven. 1 | 411 | 26.4 | 0.8/0.34/0.45 | 4075 | 1809 | — |
| Conven. 2 | 410 | 23.3 | 0.9/0.3/0.48 | 3750 | 1358 | — |
| Conven. 3 | 404 | 29.6 | 1.2/0.4/0.58 | 4359 | 1909 | — |
| Conven. 4 | 400 | 29.2 | 1.1/0.36/0.54 | 4277 | 1965 | — |
| Conven. 5 | 249 | 21.6 | 0.7/0.12/0.15 | 4296 | 1513 | Failure |
| Conven. 6 | 215 | 4.2 | 0.7/0/0.68 | 4413 | 1549 | Failure |
| Conven. 7 | 245 | 28.9 | 0.8/0.31/0.46 | 4380 | 1785 | — |
| Conven. 8 | 242 | 28.7 | 0.8/0.33/0.48 | 4335 | 1781 | — |
| Inven. 1 | 409 | 21.4 | 0.8/0/0.3 | 3700 | 1533 | Failure |
| Inven. 2 | 408 | 20.1 | 0.9/0.01/0.36 | 3780 | 1534 | — |
| Inven. 3 | 408 | 19.3 | 0.8/0.12/0.35 | 3771 | 1565 | — |
| Inven. 4 | 402 | 28.9 | 1.2/0.44/0.6 | 4228 | 1947 | — |
| Inven. 5 | 400 | 26.1 | 1.2/0.12/0.36 | 4274 | 1855 | — |
| Inven. 6 | 212 | 29 | 0.8/0.2/0.43 | 4393 | 1735 | — |
| Inven. 7 | 226 | 28.6 | 0.8/0.26/0.43 | 4400 | 1788 | — |

The rotational speed was measured in revolutions per minute (RPM). The hole depth (or depth of penetration) was measured in inches. The feed rate was measured in inches per second, and Table III sets forth the starting, ending, and average feed rates. The average thrust was measured in pounds. The average torque was measured in inch-pounds. The style of the roof drill bit for the tests was a Kennametal KCV4-1RR (Roof Rocket) style of the roof drill bit such as that illustrated in FIG. 3 and depicted in Kennametal Mining Products Catalog A96-55(15)H6, Kennametal Inc. Latrobe Pa. 15650, (1996).

The cutting insert for the comparative tests was a cobalt tungsten carbide grade material with a composition of about 6.2 weight percent cobalt (about 10.4 volume percent) and the balance tungsten carbide with possibly minor amounts tantalum, niobium and titanium. The hardness of the grade was about 89.7 Rockwell A ($R_A$). The grade had a coercive force ($H_C$) of about 115 oersteds.

In regard to the test results, a comparison between tests of the conventional roof drill bit (Conven. Nos. 1 and 2 with tests of the roof drill bit of the invention (Inven. Nos. 2 and 3) shows that for an average rotational speed in the range of about 408–411 RPM with a starting feed rate of about 0.8–0.9 inches per minute (2.03–2.29 centimeters [cm] per minute), the conventional roof drill bit seems to perform better than the inventive roof drill bit in these dry drilling tests. More specifically, the conventional roof drill bit drills to a deeper penetration, i.e., an average penetration of 24.8 inches (62.99 cm), compared to an average penetration of 19.7 inches (50.04 cm) and has an overall greater average feed rate (0.465 inches per second [11.81 millimeters (mm) per second] as compared to 0.355 inches per second [9.08 mm per second]) with a somewhat higher thrust (an average of 3938 lbs. [1469 kilograms] compared to 3775 lbs. [1408 kilograms]).

A comparison of the conventional roof drill bit (Conven. Nos. 3 and 4) with the roof drill bit of the invention (Inven. Nos. 4 and 5) shows that for an average rotational speed in the range of 400–404 RPM with a starting feed rate of 1.1–1.2 inches per minute (2.79–3.05 cm per minute), the conventional roof drill bit seemed to exhibit slightly better performance than the roof drill bit of the invention in these dry drilling tests. More specifically, the average penetration for the conventional roof drill bit was 29.4 inches (74.68 cm) as compared to the roof drill bit of the invention which had an average penetration of 27.5 inches (69.85 cm). The average feed rate for the conventional roof drill bit was 0.56 inches per minute (14.22 mm per minute) as compared to the average feed rate for the roof drill bit of the invention of 0.48 inches per minute (10.16 mm per minute). The average thrust was about the same wherein the conventional roof drill bit had a thrust of 4318 lbs. (1161 kilograms) while the roof drill bit of the invention had an average thrust of 4251 lbs. (1586 kilograms).

A comparison of the conventional roof drill bit (Conven. Nos. 7 and 8) with the roof drill bit of the invention (Inven. Nos. 6 and 7) shows that for an average rotational speed in the range of about 212–245 RPM with a starting feed rate of 0.8 inches per minute (2.03 cm per minute), the roof drill bit of the invention exhibits performance substantially the same as that of the conventional roof drill bit in these dry drilling tests. More specifically, the average depth of penetration for the roof drill bit of the invention was 28.8 inches (73.15 cm) as compared to the conventional roof drill bit which had an average penetration of 28.8 inches (73.15 cm). The average feed rate was slightly higher for the conventional roof drill bit in that it had an average feed rate of 0.47 inches per second (11.94 cm per second) while the roof drill bit of the invention had an average feed rate of 0.43 inches per second (10.92 cm per second). The average thrust was about the same with the conventional roof drill bit having a thrust of 4358 lbs. (1626 kg) and the roof drill bit of the invention having a thrust of 4397 lbs. (1640 kg).

Figure 6:
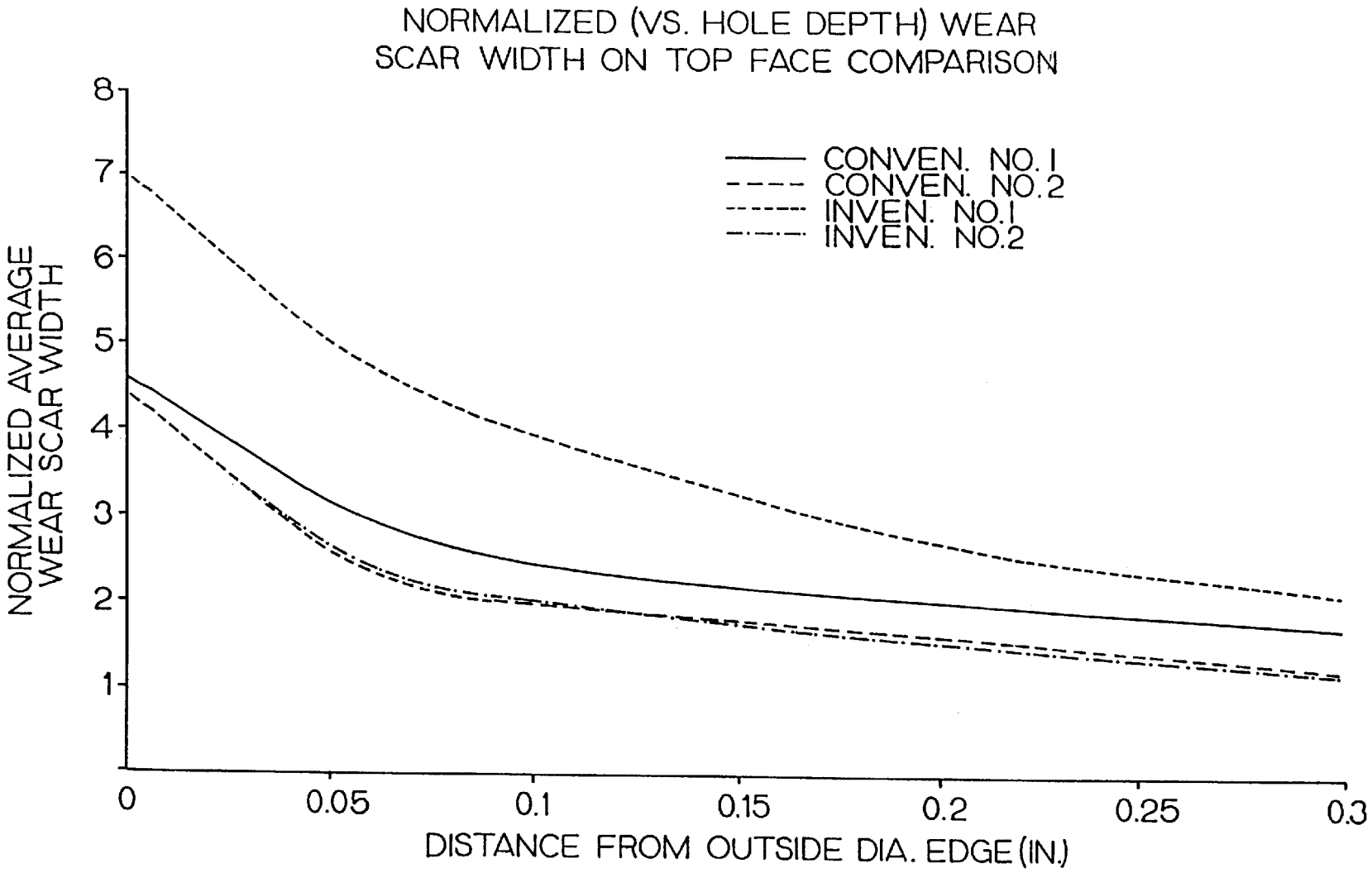
FIG. 6 is a graph showing the normalized average wear scar width (vs. the hole depth) for a roof drill bit as depicted in FIG. 3 as a function of the distance from the outside diameter edge of the cutting insert.

FIG. 6 shows the normalized (to the hole depth) average wear scar width taken at five locations away from the outside diameter edge of the cutting insert. These five locations were at the outside edge, and 0.06 inches (1.52 mm), 0.12 inches (3.05 mm), 0.2 inches (5.08 mm), and 0.3 inches (7.62 mm) radially inward from the outside edge of the cutting insert. In the graph of FIG. 6, the designation Conven. No. 1 represents the average results of measurements of the cutting inserts from the tests designated Conven. Nos. 1 through 4, the designation Conven. No. 2 represents the average results of measurements of the cutting inserts from the tests designated Conven. Nos. 7 and 8, the designation Inven. No. 1 represents the average results of the measurements of the cutting inserts from the tests designated Inven. Nos. 2 through 5, and the designation Inven. No. 2 represents the average results of the measurements of the cutting inserts from the tests designated Inven. Nos. 6 and 7. The tests (Conven. Nos. 5 and 6, and Inven. No. 1) which resulted in a failure of the cutting insert were not taken into consideration in the wear measurements.

This graph shows that for the tests performed where the average rotational speed was in the range of 408 to 411 RPM, the conventional roof drill bit seemed to show better wear characteristics than the roof drill bit of the invention. For the tests performed where the average rotational speed was in the range of 212 RPM to 245 RPM, the wear characteristics of the roof drill bit of the invention seemed to be equivalent (or substantially equivalent) to the conventional roof drill bit.

Although tests were not performed under corrosive conditions, applicants believe that under corrosive conditions the performance of the roof drill bit of the invention would be better than that of the conventional roof drill bit, especially under those dry drilling parameters wherein the roof drill bit of the invention had performance equivalent to, or substantially the same as, that of the conventional roof drill bit.

Figure 7:
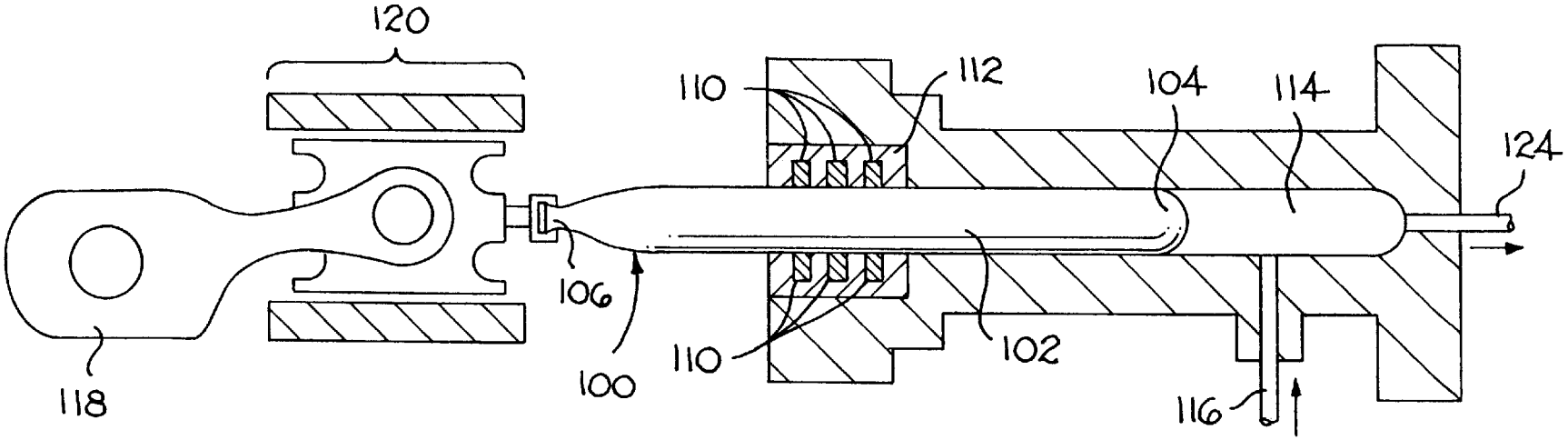
FIG. 7 is a schematic representation of a plunger within a portion of a hypercompressor.

FIG. 7 schematically depicts a plunger 100 contained within a portion of a hypercompressors used in the manufacture of low density polyethylene (LDPE) or copolymer. Plunger 100 comprises an elongated body 102 having a first end 104 and a second end 106. The surface of the elongated body 102 may have a mirror-like finish and engages seals 110 of a seal assembly 112 contained within a portion of compressor body. The second end 106 of the plunger 100 comprises an attachment means which facilitates the reciprocation of the plunger 100 to compress materials introduced into the compression chamber 114 through the feed stream 116. A coupling means 118 attached to a drive means and a reciprocation guide means 120 drives the plunger 100 within the compression chamber to create a prescribed pressure with the feed stock materials which are then ejected through the exit stream 124. For a wear application, the preferred average grain size of the tungsten carbide is greater than about 2 $\mu$m.

It can thus been seen that applicants' invention provides for a rotary tool, as well as the hard insert for the rotary tool, which overcomes certain drawbacks inherent in the use of cobalt as a binder in the hard insert. More specifically, the use of a nickel-chromium binder alloy instead of a cobalt binder alloy in the hard insert reduces the cost of the hard insert and the overall rotary tool. The use of a nickel-chromium binder alloy instead of a cobalt binder alloy in the hard insert eliminates the potential that the principal component, i.e., cobalt, for the binder alloy will be unavailable due to political instability in those countries which have had significant cobalt production. It also becomes apparent that applicants' invention provides a rotary tool, and a hard insert therefor, which possess improved corrosion resistance without sacrificing wear properties equivalent to those of a tungsten carbide-cobalt hard insert.

The patents and other documents identified herein are hereby incorporated by reference herein.

Other embodiments of the invention will be apparent to those skilled in the art from a consideration of the specification or practice of the invention disclosed herein. It is intended that the specification and examples be considered as illustrative only, with the true scope and spirit of the invention being indicated by the following claims.

What is claimed is:

1. A tool for engaging the earth strata, the tool comprising:

a tool body, and a hard insert affixed to the tool body; and the composition of the hard insert comprising from about 5 volume percent to about 40 volume percent binder alloy and between about 60 volume percent and about 95 volume percent tungsten carbide;

the tungsten carbide having an average grain size greater than about 2 micrometers; and the binder alloy comprising an alloy of nickel and chromium wherein the nickel ranging between about 70 weight percent and less than 93 weight percent and the chromium ranging between greater than 7 weight percent and about 30 weight percent.

2. The tool of claim 1 wherein the composition of the hard insert comprises from about 19 volume percent to about 36 volume percent binder alloy.

3. The tool of claim 1 wherein the composition of the hard insert consists essentially of from about 16 volume percent to about 40 volume percent binder alloy and from about 60 volume percent to about 84 volume percent tungsten carbide, and wherein the binder alloy consists essentially of nickel and chromium.

4. The tool of claim 3 wherein the binder alloy consists essentially of about 80 weight percent nickel and about 20 weight percent chromium.

5. The tool of claim 1 wherein the tool is a point attack style of tool having an elongate tool body with an axially forward end and an axially rearward end, and the hard insert affixed to the tool body at the axially forward end thereof; the elongate tool body has a central longitudinal axis, and the point attack style tool is rotatable about its central longitudinal axis during use.

6. The tool of claim 1 wherein the tool is a point attack style of tool having an elongate tool body with an axially forward end and an axially rearward end, and the hard insert affixed to the tool body at the axially forward end thereof; the elongate tool body has a central longitudinal axis, and the point attack style tool is non-rotatable about its central longitudinal axis during use.

7. The tool of claim 1 wherein the composition of the hard insert comprises between 81 volume percent and 87 volume percent tungsten carbide and between 13 volume percent and 19 volume percent binder alloy.

8. The tool of claim 7 wherein the nickel in the binder alloy ranges between about 70 weight percent and less than 90 weight percent and the chromium in the binder alloy ranges between greater than 10 weight percent and about 30 weight percent.

9. The tool of claim 8 wherein the binder alloy comprises between 75 weight percent and 85 weight percent nickel and between 15 weight percent and 25 weight percent chromium.

10. The tool of claim 1 wherein the tool is a rotary tool, and the composition of the hard insert comprises between about 8 volume percent and about 18 volume percent binder alloy, and between about 87 volume percent and about 92 volume percent tungsten carbide.

11. The tool of claim 1 wherein the tool is a rotary tool, and the composition of the hard insert comprises between about 13 volume percent and about 17 volume percent binder alloy and between about 83 volume percent and 87 volume percent tungsten carbide.

12. The tool of claim 1 wherein the tool is a rotary tool, and the composition of the hard insert consists essentially of between about 5 volume percent and about 40 volume percent binder alloy and between about 60 volume percent and about 95 volume percent tungsten carbide, and wherein the binder alloy consists essentially of nickel and chromium.

13. The tool of claim 1 wherein the tool is a rotary tool, and the hard insert comprises between 87 volume percent and 93 volume percent tungsten carbide and between 7 volume percent and 13 volume percent binder alloy.

14. The tool of claim 1 wherein the tool is a rotary tool, and the tungsten carbide has an average grain size of greater than about 3 $\mu$m.

15. A hard insert for use in a tool having a tool body wherein the hard insert is affixed to the tool body, the composition of the hard insert comprising:

between about 5 volume percent and about 40 volume percent binder alloy, and between about 60 volume percent and about 95 volume percent tungsten carbide;

the tungsten carbide having an average grain size of greater than about 2 micrometers; and the binder alloy comprising an alloy of nickel and chromium wherein the nickel ranges between about 70 weight percent and less than 93 weight percent and the chromium ranges between greater than 7 weight percent and about 30 weight percent.

16. The hard insert of claim 15 wherein the composition of the hard insert consists essentially of between about 8 volume percent and about 40 volume percent binder alloy and between about 60 volume percent and about 92 volume percent tungsten carbide, and wherein the binder alloy consists essentially of nickel and chromium.

17. The hard insert of claim 15 wherein the average grain size of the tungsten carbide is greater than about 3 $\mu$m.

* * * * *